United States Patent [19]

Budin

[11] Patent Number: 4,919,024

[45] Date of Patent: Apr. 24, 1990

[54] HARP MADE FROM COMPOSITE MATERIAL

[76] Inventor: Didier Budin, 30, Avenue de la Grande Armee, 75017 Paris, France

[21] Appl. No.: 226,367

[22] Filed: Jul. 29, 1988

[30] Foreign Application Priority Data

Jul. 31, 1987 [FR] France ..... 87 10900

[51] Int. Cl.[5] ..... G10D 1/04

[52] U.S. Cl. ..... 84/265

[58] Field of Search ..... 84/264–266

[56] References Cited

U.S. PATENT DOCUMENTS

| | | | |
|---|---|---|---|
| 147,689 | 2/1874 | Reed | 84/265 |
| 526,630 | 9/1894 | Lehman | 84/265 |
| 608,058 | 7/1898 | Lyon | 84/264 |
| 1,501,907 | 7/1924 | Kirk | 84/264 |
| 1,637,539 | 8/1927 | Starke | 84/264 |
| 1,702,643 | 2/1929 | Claiborne | 84/264 |
| 1,817,951 | 8/1931 | Starke | 84/264 |

*Primary Examiner*—Lawrence R. Franklin

*Attorney, Agent, or Firm*—Bachman & LaPointe

[57] ABSTRACT

The present invention is drawn to a harp formed of a plurality of constituent parts wherein the plurality of constituent parts are produced from composite materials. In accordance with the present invention the composite materials from which the constituent parts are formed are selected from the group consisting of carbon, polyparaphenyleneterephthalamide, glass fibers and mixtures thereof.

10 Claims, 1 Drawing Sheet

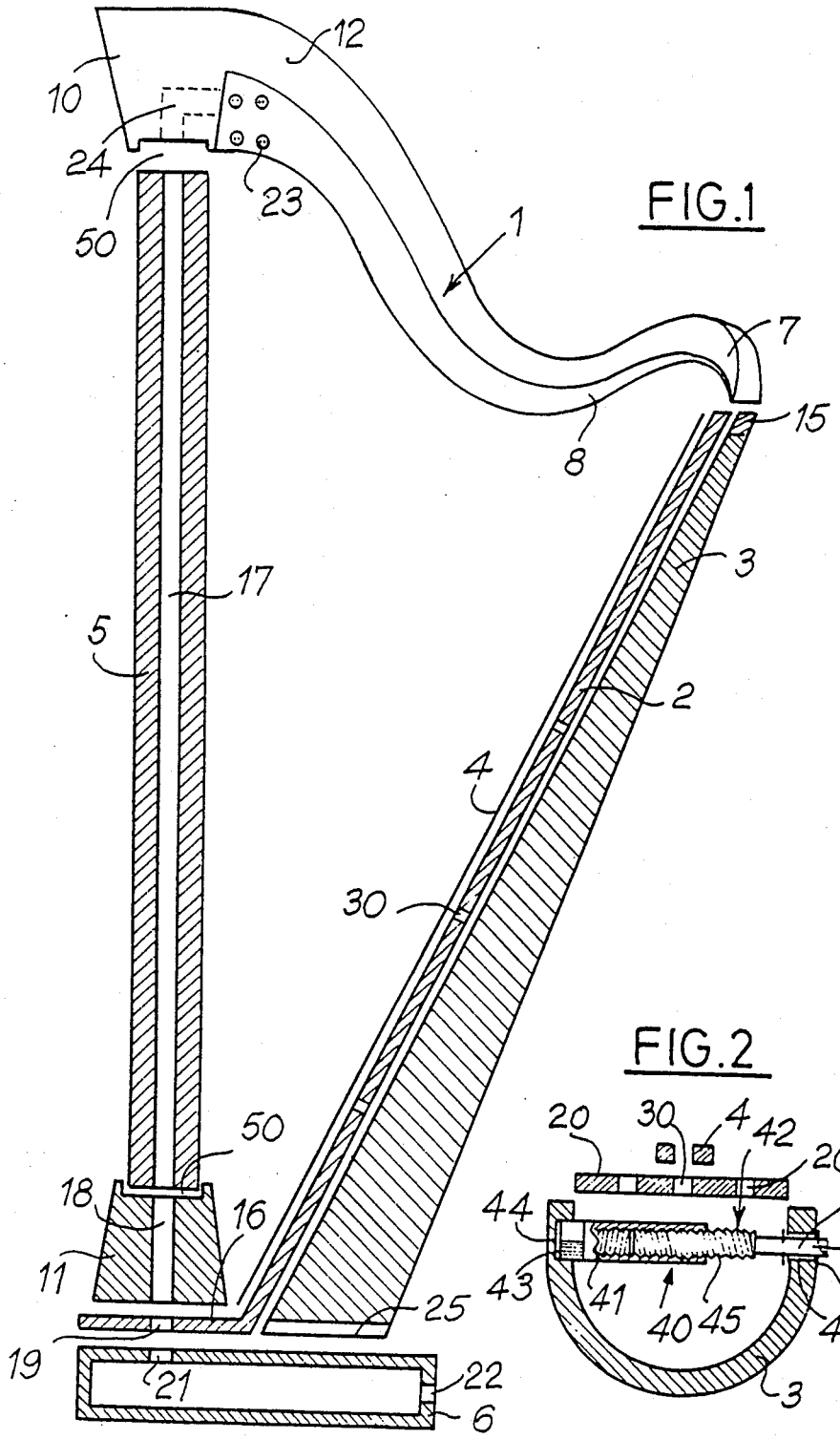
FIG.1
FIG.2
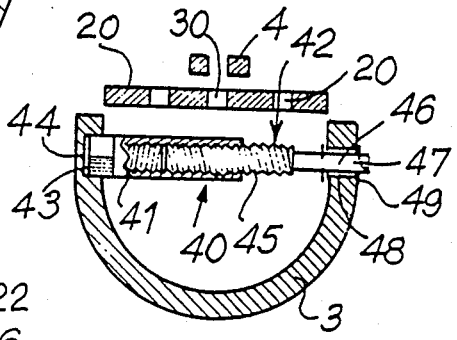

HARP MADE FROM COMPOSITE MATERIAL

The present invention relates to a harp and more particularly to a novel harp made from composite material.

Harps have been known since antiquity, and are traditionally produced from wood. A harp comprises a set of strings stretched between an arm known as a "neck" and a sound board fixed to a resonating body, this body being placed at about 30° to 35° relative to the direction of the strings. The body is connected on the one hand to the neck via an upper sill and an angled piece know as a pier, and on the other hand to the base via a lower sill. The harp further comprises a vertical pillar connecting the neck to the said base.

The two best known types of harp are pedal harps and Celtic harps. In pedal harps, the vibrating length of each string can be adjusted by an "action", which makes it possible to obtain the sharp and natural inflections. Consequently, the pillar is pierced by a longitudinal central aperture allowing the passage of a plurality of rods linking the action situated on the neck to control pedals positioned in the base.

By contrast, in Celtic harps, there are no pedals and it is therefore not necessary to have a hollow pillar.

Conventionally, the neck is produced from laminated/bonded wood covered with veneer, and then a pair of carved solid wood, likewise bonded, is fitted on the latter. The body is made from molded wood, it possesses a cross-section of U-shape, and it is reinforced by vertical "girders" and hoops, and provided towards the rear with apertures (sound holes) allowing the sound to escape. Upper and lower sills are fitted on its top and bottom ends, respectively receiving the pier of the neck and the base.

The soundboard is formed from slats of special woods whose thickness decreases from bottom to top and from the center towards the sides. These slats are placed edge-to-edge. This board is reinforced towards the inside by a counter-bridge of large dimensions and towards the outside by a lighter bridge. These three latter pieces are bonded together and pierced to allow the passage of the strings, and it will be noted that the bridge is reinforced at the level of this passage.

For its part, the pillar is formed from a plurality of pieces of wood of a length corresponding to the total height of the pillar, bonded parallel to each other. This pillar is mounted on the lower sill by means of a fitting.

Finally, the base supporting the assembly is formed from various pieces of wood and possesses notches for the passage of the pedals.

These harps possess numerous disadvantages: they are very heavy and hence difficult to transport, they are sensitive to variations in temperature and humidity, which cause the wood to warp, and hence the harps are in danger of becoming out of tune, breaking and becoming unbonded.

Moreover, when a repairer wishes to work on the action of a pedal harp he is obliged to remove all the strings before removing the action, in order not to break the neck, and this is a long and wearisome operation.

Moreover, the woods are not homogeneous, and it is only when the harp has been built that it is possible to say whether a good quality instrument has been produced or not.

The object of the invention is to produce a harp from composite material and no longer to use wood. Composite materials make it possible to produce a harp of a weight about 40% less than that of a conventional harp, and hence easier to transport. The composite materials also possess better mechanical characteristics, are less sensitive to variations in temperature and humidity, and are homogeneous.

A second object of the invention is to obtain a harp at a lower manufacturing cost.

A third object of the invention is to be able to remove the action easily without having to unstring all the strings.

A final object of the invention is to master the quality of the sounds and to personalize the harps in terms of their sonority, shape or color.

These objects, together with others which will become apparent in due course, are achieved by means of a harp, particularly of the type of pedal harps or Celtic harps, comprising a neck, a pier, a pillar joining the said neck to a board, a body fitted with the soundboard and with a bridge, the said body being connected on the one hand to the pier of the neck by an upper still and on the other hand to a base by a lower sill, wherein the neck and the pier are formed from one and the same piece, as are the body and its upper and lower sills, the soundboard being molded with the bridge and pierced by sound holes and possessing another lower sill extending laterally, the pillar, for its part, being produced in a single piece and being connected by each of its ends to the neck and to the second lower sill respectively by an upper cone and a lower cone, these various constituent parts of the harp being produced from identical or different composite materials.

Other features and advantages of the invention will become apparent from reading the description of a preferential embodiment of the invention which follows and which is given by way of illustration, and from the attached drawings, in which:

FIG. 1 is an exploded view of a harp according to the invention,

FIG. 2 is a sectional view of the body and of a spacer.

The harp according to the invention will now be described, and is entirely produced from composite material.

As illustrated in FIG. 1, the harp according to the invention comprises, exactly like a conventional harp, a neck 1 and a soundboard 2 fixed to a body 3 between which the strings are normally stretched. A bridge 4 is furthermore molded on the said soundboard 2, and these two units are pierced by apertures permitting the passage of the strings. A pillar 5 connects the neck 1 to a sill, and the body 3 is itself fixed on a base 6. The said base serves only to support the harp and to accommodate the pedals.

The use of a composite material, which is extremely strong, makes it possible to simplify the structure of the harp and to carry out certain modifications enabling the action to be changed without it being necessary to remove the strings. These structural modifications will now be described, beginning with the parts which are common to Celtic harps and to pedal harps.

According to the invention, the neck 1 and the pier 7, whose shapes are identical to those of conventional harps, are formed from one and the same piece. The neck 1 bears perpendicularly pegs 12 on which the strings are fixed and wound, these pegs permitting the tension of the strings to be adjusted.

The body 3 is a sort of "guttering", that is to say that its cross-section is of U-shape, while nevertheless its depth p (distance between the bottom of the said body and the aperture of the U) decreases from the bottom of the harp towards the top. This body is molded with an upper sill 15 and a lower sill 25. The upper sill 15 closes the upper U-shaped end of the body and the sill 25 closes the lower end of the said body 3. These components possess a semi-circular shape. The body 3 being wider in its lower part than in its upper part, the sill 25 is consequently of larger dimensions than the sill 15.

As shown in FIGS. 1 and 2, the body 3 is closed at the top by a soundboard 2 in the form of an isosceles trapezium extended in its lower part by a lower sill 16. The widest base of the trapezium is situated at the bottom. This sill 16 is horizontal and forms an angle of about 125° with the sound-board 2. The thickness of the soundboard 2 decreases from bottom to top and from the center towards the sides. This soundboard 2 is reinforced on the outside by a bridge 4 extending longitudinally and at the center of the said board. These two components are molded at the same time and pierced by a plurality of apertures 30 permitting the passage of the strings. It is no longer necessary to add a counter-bridge to the board. In conventional harps, it is the bottom of the body which is pierced by sound holes, but then the sound escapes in the direction of the harpist. By contrast, according to the invention, the great strength of composite materials makes it possible to pierce the sound holes 20 in the soundboard 2, without risking breaking the latter. The sound then escapes towards the listener. These soundholes 20 are regularly spaced on either side of the bridge 4 over the entire length of the board 2.

Several adjusting spacers 40 are positioned within the said body 3 towards the aperture of the U. These spacers may for example be formed by a hollow cylinder 41 threaded at one end and closed at the other, and fitted with a screw 42. The closed end of the cylinder 41 is fitted with a square piece 43 which is accommodated in a cavity 44 of the same shape and of corresponding dimensions situated on the inner face of one of the lateral walls of the body 3. Thus, once the spacer is in position, this end is locked and can no longer turn when the screw 42 is tightened. This screw 42 possesses a threaded part 45, fitted to a smooth cylinder 46 and a screw head 47. The diameter of the threaded part 45 is slightly less than the internal diameter of the cylinder 41, in a manner such that it may be screwed therein. The diameter of the cylinder 46 is less than the diameter of the threaded part 45, and this cylinder 46 is designed to pass through a cylindrical aperture 48, of very slightly greater diameter, provided in the lateral wall of the body 3 opposite the cavity 44. The screw head 47 is provided with a groove intended to permit screwing by means of a screwdriver, for example. Moreover, in order to keep the spacer in place, the cylinder 46 is provided with two grooves intended each to receive a circlip 49. The distance between the two grooves is slightly greater than the length of the aperture 48, in a manner such that, when the spacer 40 is in place, there is a groove on each side of the lateral wall of the body 3.

According to another embodiment, not shown, the cylinder 41 may be open at both ends and fitted at each end with a screw 42. The cavity 44 is then replaced by an aperture identical to the aperture 48. Thus, three spacers will preferably be used, distributed uniformly over the entire length of the body 3. These spacers make it possible to adjust the sound color, at any time, in accordance with the interpreter's tastes. In fact, by adjusting the length of the spacers 40 by means of the screw 42, the walls of the body 4 can be moved apart and the board 2 thus stretched, which modifies the sound.

The pillar 5 is cut from a standard tube of composite material, and is thus formed from a single piece and possesses a central cylindrical recess 17 extending substantially along the axis of the pillar, from one end to the other of the latter, and permitting the passage of the rods of the action as necessary. The junctions between the said pillar 5 and the neck 1 on the one hand, and between the pillar 5 and the lower sill 16 (and hence the board 2) on the other, are produced respectively by an upper cone 10 and a lower cone 11. These two cones are truncated. The small bases of the lower cone 11 and upper cone 10 are provided in the center with a cylindrical cavity 50, whose diameter corresponds to the external diameter of the pillar 5. This cavity 50 extends into the cone 11 with a recess 18 and into the cone 10 with a recess 24 described below. The recesses 18 and 24 have a diameter less than that of the cavities 50.

The pillar 5 thus fits into the cones by means of these cavities 50. These cones 10 and 11 are molded from a composite material. The joins are ensured, for example, by bonding with epoxy or polyester adhesives. With a view to being able to produce the join between the upper cone 10 and the neck 1, the latter is provided at its wider end with a semi-frustoconical cavity (not shown) corresponding to the frustum 10. Thus, this cavity partially surrounds the cone 10.

According to an alternative embodiment, the upper cone 10 may be molded with the neck 1 and the lower cone 11 may be molded directly with the lower sill 16 and the soundboard 2.

The assembly comprising the lower sills 16 and 25 is screwed to a parallelepipedal base 6.

All the other joins between the components are produced preferably by bonding with epoxy or polyester adhesives. In the particular case of harps having no action, of the "Celtic" type, it will be possible for the pillar 5 to be molded directly with the neck and the cone 10 in order to form a single assembly.

In the particular case of pedal harps, and in order to permit the passage of the rods of the action, the lower cone 11 is molded with a recess 18, the lower sill 16 with an aperture 19, and the upper cone 10 with a recess 24 terminating on the one hand in the cavity 50 and on the other hand laterally towards the neck 1. The base generally possesses five faces and does not necessarily have an upper face, though if such is the case that face will be pierced by an aperture 21. When all these components are assembled, all these recesses and apertures are superposed in order to permit the passage of the rods. Moreover, one of the lateral walls of the base 6 is provided with apertures 22 for the passage of the pedals.

In conventional harps, the action permitting the setting of the sharps and naturals (forks 23) is placed on fittings added on either side of the neck 1. When it is desired to change this action, it is necessary to remove all these strings, since otherwise the tension generated by the strings and thus acting on the neck 1 deprived of its fittings would cause the breaking of the said neck 1. By contrast, when a stronger composite material is used, two removable flanges 8 bearing the said forks 23 can be positioned under the neck 1. Each flange 8 is an elongate piece possessing an S-shape identical to that of the neck 1, and a rectangular cross-section. Each flange 8 is designed to fit exactly under the neck 1 and is thus less thick than the neck 1. The flanges 8 are fixed by pegs or screwed to the neck 1 and they are produced from composite material or possibly from metal. Thus, in the event of repair, it will be readily possible to retract the said flanges 8 without having to remove the strings, since the neck 1 will be readily able to bear the tension exerted by the strings.

All the components of the harp according to the invention are formed from composite materials selected from the group comprising glass fibers, carbon, and a fiber constituted by polyparaphenyleneterephthalamide, known commercially under the name of Kévlar. Preferably, the base 6 is made from glass fiber, the board from carbon or glass fiber, the body and the pillar from a carbon/Kévlar blend and the neck from a blend of carbon, Kevlar and glass. All these components are bonded by epoxy or polyester adhesives.

The invention is not of course limited to the exemplary embodiment described above, for which other alternative forms of embodiment can be provided without thereby going outside the scope of the invention.

I claim:

1. A harp formed of a plurality of constituent parts comprising a base, a body having a lower sill connected to said base and an upper sill, a neck having a pier on one end thereof connected to said upper sill of said body and another end connected to an upper cone on one end of a pillar, a soundboard having a bridge molded thereon fitted on said body wherein said soundboard has a lower sill connected to said base and said soundboard and bridge are pierced by a plurality of sound holes, said neck and pier being formed of one piece and said body and its upper sill and lower sill being formed of one piece, said pillar having another end provided with a lower cone connected to said lower sill of said soundboard wherein the body has a pair of lateral walls fitted internally with at least one sound adjustable spacer disposed between said lateral walls of said body.

2. A harp according to claim 1 wherein the upper cone and lower cone are independent and are respectively bonded onto the neck and the lower sill and are fitted on the ends of the pillar by virtue of cavities provided on the small bases of the cones wherein the diameter of these cavities correspond to the external diameter of the pillar.

3. A harp according to claim 1 wherein both the upper cone and lower cone are integrally molded to the neck and the soundboard, respectively.

4. A harp according to claim 1 wherein two flanges are fixed in a removable fashion to the neck, said two flanges having a shape substantially identical to said neck wherein said two flanges are formed from a composite material.

5. A harp according to claim 1 wherein the constituent parts are formed from a composite material selected from the group consisting of carbon, polyparaphenyleneterephthalamide, glass fibers and mixtures thereof.

6. A harp according to claim 1 wherein the base is formed from glass fiber, the board is formed from a material selected from the group consisting of carbon and glass fibers, the body and the pillar are formed from a blend of carbon/polyparaphenyleneterephthalamide, and the neck is formed from a blend of carbon, glass and polyparaphenyleneterephthalamide.

7. A harp according to claim 1 wherein the spacer comprises a threaded hollow cylinder fitted with at least one screw engaging in the threaded cylinder and passing through an aperture provided in the lateral wall of the body.

8. A harp according to claim 1 wherein the pillar is provided with a recess extending from one end of the said pillar to the other, the lower cone is provided with a recess, the lower sill is provided with an aperture, the upper face of the base is provided with an aperture, the upper cone is provided with a recess terminating on the one hand in the cavity and on the other hand laterally towards the neck wherein one of the lateral walls of the base is provided with at least one aperture for the passage of pedals.

9. A harp according to claim 1 wherein the pillar, the upper cone and the neck are molded from a single block of material.

10. A harp according to claim 1 wherein the body has a U-shaped cross-section having an open aperture portion and the adjustable spacer is disposed within said U-shaped cross-section toward the open aperture of the U.

* * * * *